US009238176B2

(12) United States Patent
Jörg

(10) Patent No.: US 9,238,176 B2
(45) Date of Patent: Jan. 19, 2016

(54) SUSPENSION DEVICE AND SUSPENSION SYSTEM

(76) Inventor: Wilhelm Jörg, Munich (DE)

( * ) Notice: Subject to any disclaimer, the term of this patent is extended or adjusted under 35 U.S.C. 154(b) by 0 days.

(21) Appl. No.: 13/433,934

(22) Filed: Mar. 29, 2012

(65) Prior Publication Data

US 2012/0248276 A1 Oct. 4, 2012

(30) Foreign Application Priority Data

Mar. 31, 2011 (DE) ..... 10 2011 006 583

(51) Int. Cl.

| | |
|---|---|
| ***B42F 13/00*** | (2006.01) |
| ***A63G 9/12*** | (2006.01) |
| *A47H 1/10* | (2006.01) |
| *A63G 9/00* | (2006.01) |

(52) U.S. Cl.

CPC ..... *A63G 9/12* (2013.01)

(58) Field of Classification Search

CPC ..... A63G 9/12; A63B 7/02; F16H 55/56
USPC ..... 248/317, 320, 322, 323, 324, 339; 182/5, 192, 74; 472/50, 118, 123
See application file for complete search history.

(56) References Cited

U.S. PATENT DOCUMENTS

| | | | | | |
|---|---|---|---|---|---|
| 793,331 | A * | 6/1905 | Thornley | A63B 7/02 | 248/341 |
| 955,135 | A * | 4/1910 | Chlad | A63G 9/12 | 211/123 |
| 1,207,985 | A * | 12/1916 | Null et al. | F16C 13/006 | 248/341 |
| 1,228,490 | A * | 6/1917 | Slasor | A63G 9/12 | 248/341 |
| 2,487,280 | A * | 11/1949 | Starkey | F16D 7/022 | 192/47 |
| 2,523,574 | A * | 9/1950 | Kaiser | A47D 13/105 | 248/343 |
| 2,603,272 | A * | 7/1952 | Rowand | A63G 9/12 | 248/163.2 |
| 2,728,617 | A * | 12/1955 | Edwards | A63G 9/12 | 248/341 |
| 3,271,029 | A * | 9/1966 | Grudoski | A63G 9/12 | 248/317 |
| 3,504,560 | A * | 4/1970 | Wunsch | F16H 55/56 | 474/17 |
| 4,961,558 | A * | 10/1990 | Cunard | A63G 9/12 | 248/230.3 |
| 5,176,578 | A * | 1/1993 | Smith | A63G 9/12 | 16/250 |
| 6,068,557 | A * | 5/2000 | Zeilinger | A63G 9/12 | 411/400 |
| 6,669,394 | B1 * | 12/2003 | Rieber | A63G 9/12 | 403/164 |
| 6,932,710 | B1 * | 8/2005 | Hartin | A63B 7/00 | 472/118 |
| 6,969,024 | B2 * | 11/2005 | He et al. | 242/599 | |

FOREIGN PATENT DOCUMENTS

| | | |
|---|---|---|
| DE | 80 05 495 U1 | 9/1980 |
| DE | 198 21 701 A1 | 12/1998 |
| EP | 0 520 935 A1 | 6/1992 |
| GB | 2 236 110 | 12/1998 |

* cited by examiner

OTHER PUBLICATIONS

German Office Action issued for counterpart German Patent Application No. DE63534 dated Nov. 4, 2011.

*Primary Examiner* — Jonathan Liu
*Assistant Examiner* — Muhammad Ijaz
(74) *Attorney, Agent, or Firm* — Squire Patton Boggs (US) LLP

(57) ABSTRACT

A suspension device for a connecting component (5) to which a dynamic load is mountable and which forms at least one eye, the suspension device comprising an axial member (2) fixed to a carrier (1), a roller (3) rotatably mounted on the axial member (2) and having a circumferential groove into which the connecting component (5) can be hooked in frictionally, and at least one safety device (4) adapted to be moved manually from a locking position, in which it prevents a hooking-in or hooking-off of the connecting component (5), into a release position permitting a hooking-in or hooking-off of the connecting component (5).

20 Claims, 5 Drawing Sheets

SUSPENSION DEVICE AND SUSPENSION SYSTEM

Figure 1:
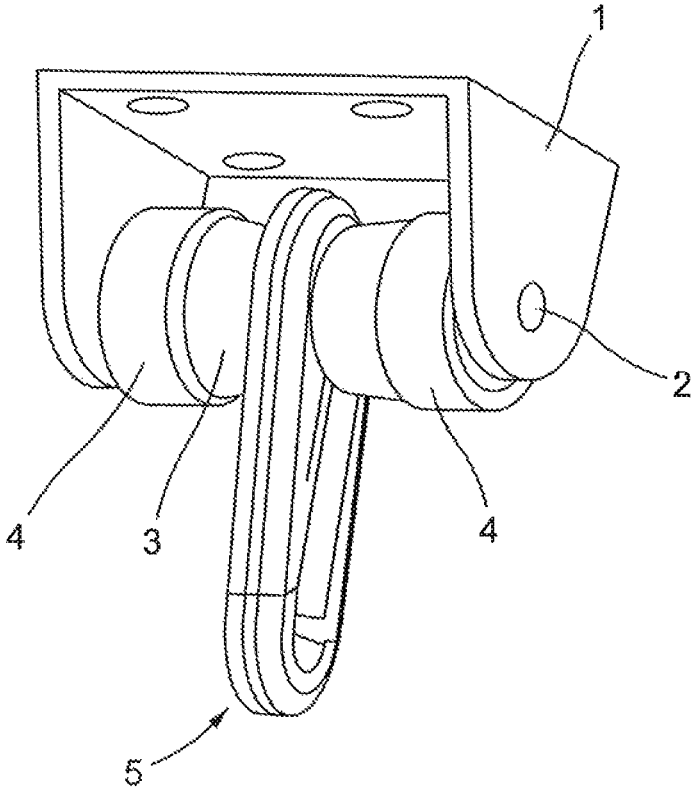

The present invention relates to a suspension device for a connecting component to which a dynamic load, such as a swing, is mountable, and to a suspension system comprising the suspension device and the connecting component.

Currently, there are two suspension systems that are used for suspending swings.

On the one hand, there is the classical hook or ring, which is firmly mounted on the ceiling and into which a load to be borne, such as a swing, is simply hooked in. In this construction, a load is suspended on a karabiner or the like, said karabiner being hooked into the hook/ring and rolling off on the bent inner circumferential surface of the hook/ring due to an oscillating movement of the load.

Although this suspension system leads to satisfactory oscillating properties, it is disadvantageous in that, when the load performs an oscillating movement, the hook/ring is subject to a strong bending stress that may lead to material fatigue. The consequence may be a breaking of the hook/ring at its weakest point.

On the other hand, suspension devices having integrated mobile joints are known. They offer a high load-carrying capacity and a high level of security against dynamic loads, and the forces occurring are directly transferred into the ceiling/wall. However, these suspension devices involve the disadvantage that a quick hooking-in and hooking-off of a load, such as a swing, is not possible without the use of tools. Furthermore, these device show a comparably high internal friction, i.e. the conservation of the kinetic energy is comparatively low, reducing a maximum duration of the oscillating movement, which is undesirable in the case of a swing, in particular.

The documents DE 198 21 701 A1, EP 0 520 935 A1, U.S. Pat. No. 1,207,985 A and DE 80 05 495 U already describe various suspension devices for a dynamic load. However, these documents do not show any safety device adapted to be moved manually from a locking position, in which it prevents a hooking-in (mounting) or hooking-off (removal) of the connecting component (5), into a release position permitting a hooking-in or hooking-off of the connecting component.

Therefore, it is an object of the present invention to provide an improved suspension device, particularly in view of the conservation of the kinetic energy, reliability and operator convenience, and a suspension system comprising said suspension device.

The problem underlying the present invention is solved by a suspension device comprising the features of claim 1 and by a suspension system according to claim 11. Advantageous further developments of the invention form the subject-matters of the dependent claims.

The inventive suspension device for a connecting component to which a dynamic load is mountable and which forms at least one eye comprises an axial member fixed to a carrier, a roller rotatably mounted on the axial member and having a circumferential groove into which the connecting component can be hooked in frictionally, and at least one safety device adapted to be moved manually from a locking position, in which it prevents a hooking-in or hooking-off of the connecting component, into a release position permitting a hooking-in or hooking-off of the connecting component. Here, dynamic loads cover all kinds of objects mountable to the connecting component and adapted to be made to move or moving in normal operation. Especially, dynamic load is to refer to a (multi-person) swing which usually moves in an oscillating manner.

In the operating position, the connecting component is frictionally hooked in the groove extending around the outer circumferential surface of the roller, i.e. at least a section of the connecting component limiting the eye is in contact with a section of the groove. In this way, the connecting component is rotatably mounted around the axial member via the roller and can rotate as one piece with the same around the axial member when a dynamic load, e.g. due to a swing mounted on the connecting component, acts thereon. As, thus, frictional forces only occur in the mounting of the roller (preferably a smooth running roller bearing), a high conservation of the kinetic energy (i.e. a long maximum duration of oscillation, particularly desired for swinging) can be achieved. An oscillating movement of the load is, thus, supported in an optimum manner. The mounting by means of the roller allows a safe accommodation of high dynamic loads. This leads to a high reliability and a long life of the suspension device.

The provided safety device, which is adapted to be moved manually, without the use of a tool, from its locking position into its release position exclusively permitting a hooking-in or removal of the connecting component increases the security and, thus, the reliability of the suspension device as well as its operator convenience. Advantageously, the safety device returns to its locking position automatically, i.e. by itself. This additionally increases security.

As the connecting component is received in the groove, a movement of the connecting component and, thus, of a load applied, is impeded from the radial plane of the axial member (the plane perpendicular to the axial member). That is to say, via the side walls of the groove, a resistance is applied to the connecting component against a movement in the axial direction. This is particularly advantageous when using the suspension device in connection with swings, as there a swinging movement (oscillating movement) is desired in one plane only. The higher the force of the weight of the load applied to the connecting component is, the more the connecting component is drawn into the groove and, accordingly, the higher the above-mentioned effect is.

Preferably, in the hooked-in state, the connecting component is held in the groove over a circumferential area of the groove of more than 60°, more preferably of more than 90°, still more preferably of more than 120°, and further preferably of more than 135°. Advantageously, the connecting component is clamped into the groove so as to strengthen the frictional engagement.

Preferably, the dimensions of the connecting component and the groove are adjusted to each other such that the hooked-in portion of the connecting component is not loose in the groove and, advantageously, their contours are adjusted to each other. Advantageously, in a cross-sectional view, more than 50% of the portion of the connecting component deepest in the groove is inside the groove.

The roller is preferably made of an elastic (semi-soft) plastic selected in dependence on the desired load-bearing capacity of the suspension device. Preferably, the roller is designed such that, if a predetermined nominal load is surpassed by a moving load fastened to the connecting component, the roller is deformed such that it gets into contact with the axial member, thereby exerting a frictional force due to which the movement of the load is decelerated. In this way, excessive load on the suspension device can be avoided and its life can be prolonged. As an alternative, the roller can be made of metal.

Preferably, the groove is arranged in the center, and the roller conically tapers from its two axial ends to the groove. This has the advantage that it counter-acts a tilting of the connecting component from the radial plane. Furthermore, the connecting component is, if it jumps out of the groove due to a high lateral force, for example, urged back into the groove due to the conical tapering towards the center. Instead of the double conical shape, however, the roller may also have a cylindrical shape.

Preferably, the carrier has a U-shaped cross-section and is provided with mounting holes. Preferably, the carrier is mounted on the ceiling, but it may also be mounted on the wall or as support on the ground.

Preferably, the safety device is arranged (coaxially to the roller) on the axial member between the carrier and the roller. Advantageously, the safety device protrudes over the outer circumference of the roller in the radial direction of the roller so as to prevent the connecting component from coming off over the roller. Advantageously, a maximum extension of the safety device in the radial direction of the roller is larger than a maximum extension of the eye. As the maximum extension of the eye is smaller than the maximum extension of the safety device, the safety device forms a stopper for the connecting component so as to prevent the latter from slipping/coming off over the ends of the roller.

Advantageously, the safety device is designed such that it cannot open during the operation of the suspension device, i.e. when the dynamic load is hooked in, i.e. does not get unintentionally into the release position. Preferably, the safety device is moved into the release position in the axial direction by a shortening of its length (e.g. by compression).

Preferably, the safety device applies a spring bias onto the roller in the axial direction. In this way, the roller can be held in a predetermined position when being in an idle state, i.e. when there is no load suspended or when there is a load suspended but not moving, particularly if safety devices are arranged on both sides of the roller. In addition, movements of the roller in the axial direction can be absorbed/balanced, i.e. forces acting in the axial direction can be taken up by the safety device, which further enhances the reliability of the system. Furthermore, this involves the advantage that the formation of a gap between the roller and the safety device, in which the connecting component can be hooked off, is reliably prevented.

Advantageously, in its locking position, the safety device is compressed to approximately 50% of its maximum spring travel. Thus, an optimum working range of the safety device is ensured, i.e. the safety device can be lengthened as well as shortened; thereby, on the one hand, movements of the roller in the axial direction can be absorbed/balanced and, on the other hand, a reliable abutment of the roller over the entire range of movement thereof is allowed.

Preferably, the safety device comprises two components spring-biased against each other in the axial direction. Advantageously, the safety device is composed of two cylindrical discs and a compression spring (preferably having a conical shape to provide for a low design height of the safety device), which is arranged between the discs and biases the discs against each other. Instead of the two discs, one may e.g. use two bowls having a cylindrical shape which engage with each other and are displaceable with respect to each (together with the spring, these then form a kind of lift cylinder having a variable length), or a combination of a disc and a cylindrical bowl. It is the advantage of this construction that the safety device can be made of few components in a simple way. With regard to an installation, a disc/bowl (preferably the one having the smaller external diameter) may e.g. directly abut on the carrier whereas the other disc (preferably the one having the larger external diameter) abuts on the inner ring of a roller bearing via which the roller is supported on the axial member.

Preferably, the discs/bowls are formed of plastics so as to keep the manufacturing cost low; they may, however, also be formed of metal.

Preferably, two of the above-described safety devices are provided and are arranged between an axial end of the roller and the carrier, respectively.

The connecting component is preferably formed to be rigid, or rather solid, e.g. a karabiner, a ring (adapted to be opened), a chain quick release fastening element, etc. Yet, the connecting component may be any other component to which a load can be fastened and which has or forms an opening or rather an eye such that it can be frictionally hooked into the groove of the roller. Advantageously, the connecting component is made of metal/steel.

Preferably, the connecting component is adapted to be opened for hooking-in and hooking-off. For this, preferably, a maximally possible opening is less than the minimum external diameter of the roller and larger than the maximum diameter of the axial member.

In the following, the invention will be described by means of preferred embodiments with reference being made to the Figures.

FIG. 1 is a schematic diagram of a perspective view of the suspension device according to the invention.

Figure 2A:
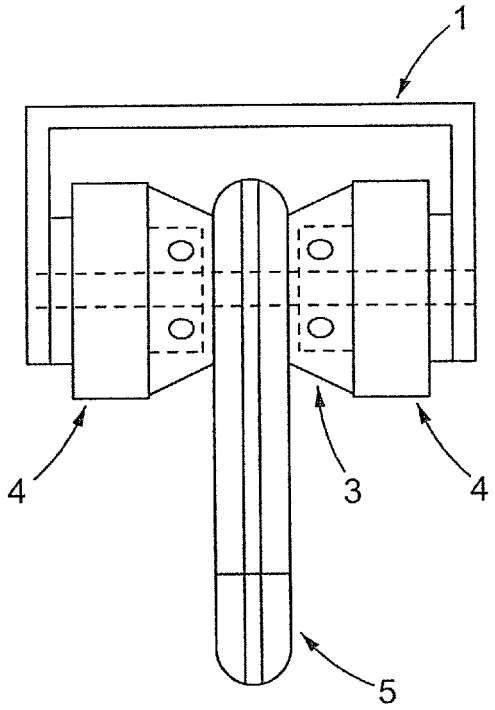

FIG. 2*a* is a schematic diagram of a front view of the suspension device according to the invention, showing locking position.

Figure 2B:
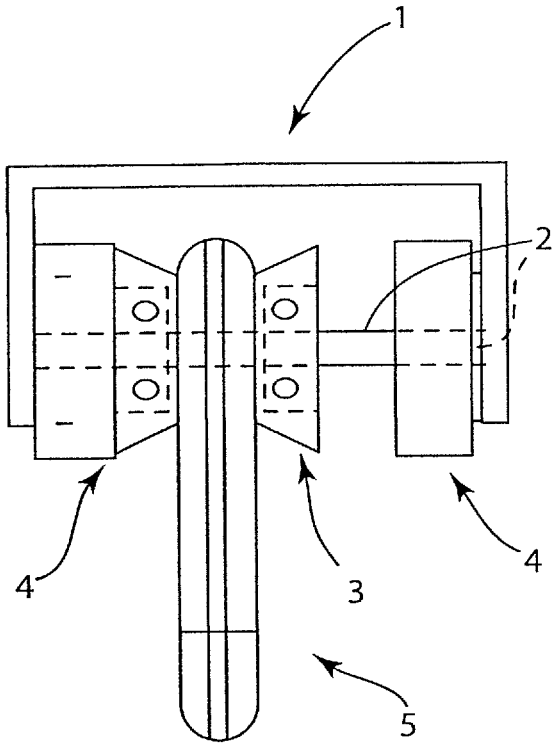

FIG. 2*b* is a schematic diagram of a front view of the suspension device according to the invention, showing release position.

Figure 3A:
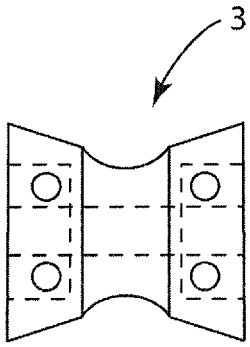

FIG. 3*a* is a sketch of a lateral view of a roller of the suspension device according to the invention.

Figure 3B:
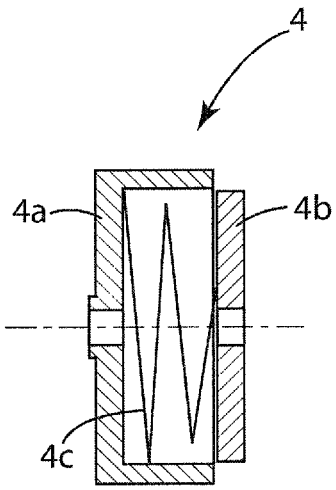

FIG. 3*b* is a cross-sectional sketch of a safety device of the suspension device according to the invention, showing the spring at approximately 50% of its maximum spring travel.

Figure 3C:
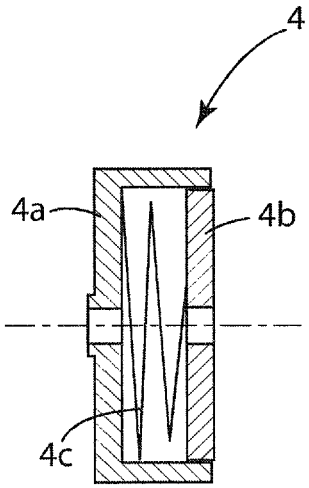

FIG. 3*c* is a cross-sectional sketch of a safety device of the suspension device according to the invention, corresponding to release position.

Figure 4:
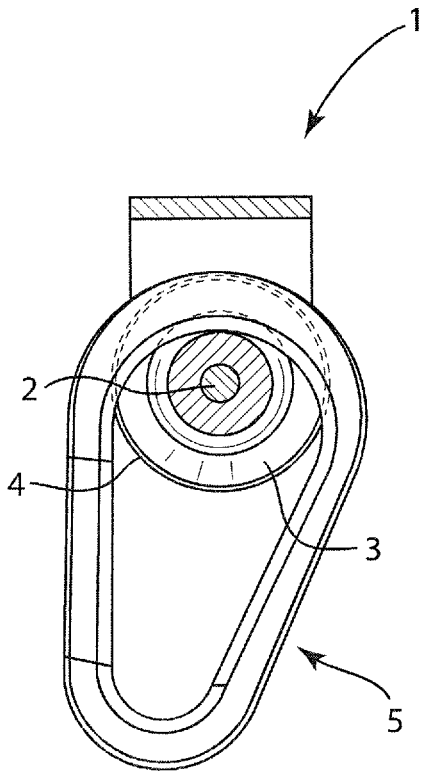

FIG. 4 is a schematic diagram of a side view of the suspension device according to the invention.

First of all, with reference to FIGS. 1 and 2*a*, a preferred embodiment of the suspension device according to the invention is described. This basically consists of a carrier 1, an axial member 2, a roller 3, two safety devices 4 and a connecting component 5.

The carrier 1, here: a carrier for a ceiling suspension, has a U-shape and comprises a base plate having bore holes for being mounted to the ceiling and two legs arranged at a 90° angle to the base plate. The two legs of the carrier 1 hold the rigid axial member in a fixed manner; for example, the axial member 2 is plugged and clamped into the carrier, or is welded thereon. The roller 3 and the two safety devices 4 are pushed onto the axial member 2.

As is shown in FIG. 3*a*, the roller 3, which is formed of an elastic plastic, has a centrally arranged groove extending around the outer circumference thereof, and is tapered in a conical shape from its two axial ends to the groove; however, the roller 3 instead of tapering may also be formed in a cylindrical shape. Furthermore, the broken lines in FIG. 3*a* serve to suggest two roller bearings via which the roller 3 is mounted so as to be rotatable around the axial member and displaceable in the axial direction (an inner diameter of the roller bearing is larger than the diameter of the axial member). The construction with the two roller bearings involves the advantage that, compared to the application of force to one point, a local bending stress is reduced, as a load applied by the connecting component 5 to the roller 3 is transmitted to the axial member via the two roller bearings, i.e. is distributed to two transmission points. This, in turn, increases the safety and the reliability of the whole device.

The suspension device according to the present embodiment comprises two identically constructed safety devices 4 mounted in a mirror-inverted manner, each of which is arranged between a leg of the carrier 1 and an axial end of the roller 3. In the following, the basic construction of such a safety device 4 is described with reference to FIG. 3*b*, in particular, this figure showing a cross-section of the safety device 4. As is shown in FIG. 3*b*, the safety device is composed of two cylindrical discs 4*a*, 4*b* having a central bore hole and a conically shaped compression spring 4*c* which is arranged in between and biases the discs against each other. One disc 4*a* is recessed so as to provide a spring seat for the compression spring. Preferably, the recess is dimensioned such that the discs can (partly) be fitted into each other, i.e. the safety device forms a kind of lifting cylinder with an increasable/reducible length in the axial direction.

In the mounted state (cf. FIGS. 1 and 2*a*), in which the discs are plugged via their bore holes onto the axial member 2 and are slidably supported, the disc having the smaller diameter abuts on the leg of the carrier 1, and the disc having the larger diameter abuts on the inner ring of the roller bearing via the circumferential protrusion shown in FIG. 3*b* (or a spacer). That is, the safety device only contacts the inner ring of the roller bearing, but not the roller 3, so that a rotation of the roller 3 is not obstructed. The axial length of the protrusion or spacer is dimensioned such that the distance between the disc having the large diameter and the axial end face of the roller is minimal (preferably less than 1 mm).

The external diameter of the larger disc has been selected such that it protrudes over the outer circumference of the roller in the radial direction of the roller 3, as shows FIG. 2*a*. As is described further below, this protrusion prevents a lateral jumping-off of the connecting component 5 off the roller 3. Preferably, in the installed state (and with the load not being fastened), each safety device 4 is compressed to approximately 50% of its maximum spring travel (see FIG. 3*b*). As can be seen from FIG. 2*a*, the spring bias of both safety devices 4 has been selected to be equally large, so that the roller is held centrally on the axial member 2 at the same distance to the legs of the carrier 1.

In this embodiment, the connecting component 5 is a karabiner made of steel; the inner area limited by the contour of the karabiner is the "eye" thereof. At its upper end, the connecting component 5 is hooked into the groove of the roller 3, as shows FIG. 1. The contours or profiles of the connecting component 5 and the groove are preferably adjusted such that they provide for a certain clamping effect between the groove and the connecting component 5.

As already indicated above, the maximum extension of the eye of the connecting component 5 is smaller than the outer diameter of the larger discs of the safety devices 4, so that the discs form a stopper for the connecting component 5 in the axial direction of the roller 3 and, in this way, prevent a slipping/coming off of the connecting component over the axial ends of the roller 3 (see FIG. 4).

A load, such as a (multi-person) swing, is hooked in/fastened to the end of the connecting component 5 that is not hooked in the roller 3 (at the lower end in FIG. 1).

In the following, the mode of operation and the operational states of the suspension device according to the embodiment will be described.

First of all, the mode of operation and the operational states in load operation are described; here, load operation is to refer to a state in which a load, such as a swing, is attached to the connecting component 5.

In the idle state, i.e. when the load is not moved, the weight of the load causes the connecting component 5 to be further pressed into the groove of the roller 3 so as to be securely held therein. The weight force of the load is applied via the connecting component 5 directly onto the roller 3 and, from there, via the axial member 2 into the carrier 1.

When the load makes an oscillating movement around the axial member 2, the frictional engagement makes the connecting component 5 rotate as one piece with the roller 3 around the axial member 2. As, thus, a frictional force is only produced at the bearing of the roller 3, the largest possible conservation of the kinetic energy, i.e. the swinging movement, can be achieved. Moreover, a material fatigue, particularly of the connecting component 5, can be avoided in an advantageous manner.

If a static or dynamic load exceeds a predetermined load-bearing capacity, the roller 3 is deformed and is pressed against the axial member 2 at its inner circumferential surface. This causes an increase in friction, so that a dynamic load is decelerated and, as the case may be, is slowly brought to a standstill. In this way, an overload on the suspension device is avoided.

Next, the mode of operation of the suspension device in the case of laterally acting forces is described, said forces being transmitted to the roller 3 via the connecting component 5. In this connection, laterally acting forces are forces substantially acting in the direction of the axial member 2 and being caused for instance by a movement of the load in this direction.

When the laterally acting forces are small, the connecting component 5 remains in the groove and does not or hardly tilt from the radial plane (the plane perpendicular to the axial member 2), as the groove, particularly its side walls, applies a counter-force working against the acting force. In this way, a stable operational position is ensured.

When the laterally acting forces are rather large, the part of the connecting component 5 which is hooked in the groove (the upper part in FIG. 1) largely remains in the groove, whereas the opposite part (the lower part in FIG. 1) of the connecting component 5 tilts out of the radial plane. The tilting is limited by the safety device 4. Especially, as from a specific tilting degree, the lower end of the connecting component 5 abuts on a disc having a rather large diameter of the safety devices 4, thereby preventing a further tilting. When the laterally acting force subsequently gets smaller again, the connecting component tilts back into its original position, i.e. into a position as the one shown in FIG. 2*a*, the tilting being supported by the conical shape of the roller 3.

Very large laterally acting forces, which are caused, for example, by an abrupt change of load, may lead to the connecting component 5 jumping out of the groove. In this case, too, the safety devices 4 prevent a slipping of the connecting component 5 down over the axial ends of the roller 3, as their external diameter is larger than a maximum extension of the eye of the connecting component 5. When the laterally acting force slackens, the connecting component 5 moves back into the groove into its original position, as shows FIG. 2*a* (back into the radial plane), this movement in turn being supported by the conical shape of the roller 3.

Additionally, movements of the roller 3 on the axial member are absorbed/balanced by the safety devices 4 due to laterally acting forces. This means, laterally occurring forces may, in principle, cause a shifting of the roller 3 to an outermost position on a leg of the carrier. When this occurs, a safety device 4 is maximally compressed in the axial direction while the other safety device 4 becomes maximally enlarged in the axial direction. Accordingly, all parts on the axial member 2 remain under tension due to the springs provided in the safety devices 4, i.e. no gap is formed in the axial direction between the axial ends of the roller 3 and the safety devices 4. Therefore, a high level of security against an unintended hooking off/coming off of the connecting component 5 is provided.

Next, it will be described how the connecting component 5 is hooked into and hooked off (detached from) the groove.

In order to improve security even further, hooking in and hooking off the connecting component 5 is exclusively possible by operating one of the safety devices 4. For hooking in, the roller 3 is held tight and one of the safety devices 4 is compressed (for example, directly by hand or by the connecting component 5 held in the hand) (see FIG. 3*c*), so that a gap in which the axial member 2 is exposed is formed in the axial direction between the roller 3 and the safety device 4 (release position).

FIG. 2*b* is a schematic diagram of a front view of the suspension device according to the invention, showing release position.

In the next step, the opened connecting component 5 is hooked in this gap into the axial member 2. In this context, it has to be mentioned that, according to the invention, a maximally possible opening range of the connecting component 5 has to be dimensioned such that the connecting component 5 can exclusively be hooked in/off on the axial member 2 and cannot directly be hooked into/off the groove of the roller 3.

After the connecting component 5 has been hooked in on the axial member 2, the connecting component 5 is closed, lifted over an axial end of the roller 3 and inserted into the groove. When the connecting component is lifted over the axial end of the roller 3, the gap automatically closes due to the spring bias of the safety device 4, and the safety device 4 is once again in its locking position.

Removing the connecting component 5 takes place in reverse order.

As has already been described above, it is not possible in the operating state to detach the connecting component directly from the roller 3 ("hook it off"), as all diameters of the roller 3 and all opening dimensions of the connecting component 5 are adjusted to each other such that the connecting component 5 cannot be opened or cannot be opened far enough for allowing it to get hooked off.

The present embodiment offers the following advantages:

The frictional accommodation of the connecting component 5 in the circumferential groove of the roller 3 supported on the axial member 2 by means of roller bearings provides a very high conservation of the kinetic energy in an oscillation plane while movements in a lateral direction thereto are impeded, which is particularly advantageous for a use in connection with swings.

The suspension device offers a high degree of security and reliability. On the one hand, the mounting by means of the roller 3 allows a safe accommodation of large and permanent loads. On the other hand, the safety device 4 takes care that the connecting component 5 can easily be hooked in and off, but that an unintentional hooking off of the connecting component 5 is avoided. Furthermore, the safety device 4 is adapted to absorb laterally acting forces.

A manual hooking in and off of the connecting component 5 is possible without any further auxiliary means being required, so that a maximum operator convenience is ensured.

Moreover, the suspension device according to the invention is composed of very few individual parts, which can be produced at low cost and can be mounted very easily.

In addition, the mounting via the roller 3 makes the suspension device work with hardly a sound being produced.

In particular, the suspension device according to the invention is extremely advantageous for use with swings, as it supports an oscillating movement in the radial direction around the axial member 2 while impeding or cushioning transverse movements thereto.

An additional safety aspect is provided by the connecting component 5 still being held by the axial member 2 even if, for instance, the roller 3 or the discs of the safety devices 4 should break due to an overload. This is of special significance for swings so as to minimize the risk of getting injured.

Although the suspension device of the above embodiment comprises two safety devices 4, it is also possible to provide one safety device 4 only.

The use of the suspension device according to the invention is not limited to a suspension of swings—although this is preferred. For instance, the suspension device is adapted to be used for guiding long goods/rods. When this is done, the long goods/rods can be guided in the groove of the roller 3, the resilient safety devices allowing a play/a certain movement in the transverse direction. The suspension device according to the invention is adapted to be mounted on the ceiling, on the wall, and as support on the ground, as well. It may also be mounted on existing profile rail systems at standardized distances.

Furthermore, the suspension device according to the invention is adapted to be incorporated into an automotive component, which moves loads, or into an automatic sensing component for controlling movements and for adjusting the suspension height of loads, particularly for the control of individual rope lengths. In this context, it is further conceivable that influence may also be exerted on the angle of inclination of the suspended loads.

The materials used may be selected depending on the purpose, e.g. for outdoor applications, possibly near the sea, weather-proof materials, such as high-grade steel, may be used.

Although the embodiment shown describes the variant according to which the connecting component 5 can be opened to be hooked into the axial member 2, it is also possible to use a closed connecting component, such as a ring, which can be hooked in by pulling the axial member 2 partly out of the carrier.

The invention claimed is:

1. A suspension device, comprising:

a carrier configured to be fixedly attached to a surface;

an axial member fixed to the carrier and being disposed along an axis;

a roller rotatingly disposed on the axial member, said roller including a circumferential groove configured to receive and engage a connecting component, wherein the connecting component is configured to support a dynamic load;

at least one safety device disposed on the axial member adjacent a first side of the roller, said at least one safety device comprising a spring and a first disc, wherein the spring biases the first disc so that the first disc is movable along the axis from a locking position to prevent removal of the connecting component, to a release position wherein it permits attachment or removal of the connecting component, wherein, in the release position, a gap is formed between the first disc and the roller, such that the axial member is exposed in the gap, which enables attaching or removal of the connecting component to or from the axial member at the gap, and wherein in the locking position the connecting component is prevented from hooking in or hooking off of the suspension device, and wherein in the locking position, the axial member remains covered.

2. The suspension device according to claim 1, wherein the spring biases the first disc, so as to urge the first disc from the release position to the locking position.

3. The suspension device according to claim 1, wherein the first disc has a diameter which is greater than a diameter of the roller.

4. The suspension device according to claim 1, wherein the at least one safety device applies a spring bias to the roller.

5. The suspension device according to claim 1, wherein in the locking position, the spring is compressed to approximately 50% of a maximum spring travel.

6. The suspension device according to claim 1, wherein the at least one safety device comprises a second disc which engages a distal end of the spring, wherein the second disc has a diameter which is less than a diameter of the first disc.

7. The suspension device according to claim 1, wherein the at least one safety device is disposed between the first side of the roller and the carrier.

8. The suspension device according to claim 1, wherein a second side of the roller is adjacent the carrier.

9. The suspension device according to claim 1, further comprising the connecting component, wherein the connecting component includes an aperture therein, and wherein the first disc has a diameter which is greater than a maximum diameter of said aperture.

10. A suspension device, comprising:

a carrier configured to be fixedly attached to a surface;

an axial member fixed to the carrier and being disposed along an axis; a roller rotatingly disposed on the axial member, said roller including a circumferential groove configured to receive and engage a connecting component, wherein the connecting component is configured to support a dynamic load;

a first safety device disposed on the axial member adjacent a first side of the roller, said first safety device comprising a first spring and a first disc, wherein the first spring biases the first disc so that the first disc is movable along the axis from a locking position to prevent removal of the connecting component, to a first release position wherein it permits attachment or removal of the connecting component; and a second safety device including a second spring and a second disc, said second safety device being disposed on the axial member on a second side of the roller, wherein the roller is disposed between the first and second safety devices, and wherein the second disc is configured to be movable from the locking position to prevent removal of the connecting component, to a second release position wherein it permits attachment or removal of the connecting component, wherein, in the first and second release positions, a gap is formed between one of the first and second discs and the roller, such that the axial member is exposed in the gap which enables attaching or removal of the connecting component to and from the axial member at the gap, and wherein in the locking position the connecting component is prevented from hooking in or hooking off of the suspension device, and wherein in the locking position, the axial member remains covered.

11. The suspension device according to claim 10, wherein the first and second springs bias the first and second discs, respectively, so as to urge the first and second discs from the first or second release positions to the locking position.

12. The suspension device according to claim 10, wherein each of the first disc and the second disc have a diameter which is greater than a diameter of the roller.

13. The suspension device according to claim 10, wherein the first and second safety devices apply a spring bias to the roller.

14. The suspension device according to claim 10, wherein in the locking position, the first and second springs are compressed to approximately 50% of a maximum spring travel.

15. The suspension device according to claim 10, wherein the first safety device further comprises a third disc which engages a distal end of the first spring, wherein the third disc has a diameter which is less than a diameter of the first disc.

16. The suspension device according to claim 10, wherein the second safety device further comprises a fourth disc which engages a distal end of the second spring, wherein the fourth disc has a diameter which is less than a diameter of the second disc.

17. The suspension device according to claim 10, wherein the first safety device is disposed between the first side of the roller and the carrier.

18. The suspension device according to claim 10, wherein the second safety device is disposed between the second side of the roller and the carrier.

19. The suspension device according to claim 10, further comprising the connecting component, wherein the connecting component includes an aperture therein, and wherein the first disc has a diameter which is greater than a maximum opening of said aperture.

20. The suspension device according to claim 10, further comprising the connecting component, wherein the connecting component includes an aperture therein, and wherein the second disc has a diameter which is greater than a maximum opening of said aperture.

* * * * *